US012071773B2

(12) United States Patent
Pierce et al.

(10) Patent No.: US 12,071,773 B2
(45) **Date of Patent: *Aug. 27, 2024**

(54) HIDDEN EDGE FOR FLOORING FINISHING

(71) Applicant: COLUMBIA INSURANCE COMPANY, Omaha, NE (US)

(72) Inventors: William Drew Pierce, Cartersville, GA (US); Christopher David Steele, Adairsville, GA (US); Daniel Jay Tumlin, Cartersville, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/357,664

(22) Filed: Jul. 24, 2023

(65) Prior Publication Data

US 2023/0366216 A1 Nov. 16, 2023

Related U.S. Application Data

(63) Continuation of application No. 17/179,491, filed on Feb. 19, 2021, now Pat. No. 11,746,543.

(60) Provisional application No. 62/979,583, filed on Feb. 21, 2020.

(51) Int. Cl.
*E04F 19/06* (2006.01)
*A47G 27/02* (2006.01)

(52) U.S. Cl.
CPC ..... *E04F 19/061* (2013.01); *A47G 27/0268* (2013.01)

(58) Field of Classification Search
CPC ..... E04F 19/061; A47G 27/0268
See application file for complete search history.

(56) References Cited

FOREIGN PATENT DOCUMENTS

DE 29912240 U1 * 9/1999 ..... A47G 27/0268
GB 2198941 A * 6/1988 ..... A47G 27/0462

* cited by examiner

*Primary Examiner* — Patrick J Maestri
(74) *Attorney, Agent, or Firm* — Lathrop GPM LLP; Laura A. Labeots

(57) ABSTRACT

This application discloses a flooring edge finish that includes a flexible strip having an adhesive affixed to a top surface of the flexible strip and a hinge, wherein the hinge is a gap or an absence of the adhesive or a lower amount of the adhesive, on a portion of the top surface of the flexible strip, and wherein the flooring edge finish is upwardly foldable along the hinge to bind, protect, and conceal a flooring edge.

20 Claims, 6 Drawing Sheets

HIDDEN EDGE FOR FLOORING FINISHING

CROSS-REFERENCE TO RELATED APPLICATIONS

This application is a continuation of U.S. patent application Ser. No. 17/179,491, filed Feb. 19, 2021, which claims the benefit of priority to U.S. Provisional Patent Application No. 62/979,583, filed on Feb. 21, 2020, the entirety of each are incorporated herein by reference.

BACKGROUND

Carpeting and hard surface flooring can function as beautiful additions to any home or business. The durability and esthetics of the finishing of many of these products need improvement, however. Generally, carpets that are not fitted to a wall have an exposed edge that should be bound to prevent fraying of the carpet fibers and to prevent damage to the carpet backing underneath. Similarly, hard surface flooring can have a ragged and uneven edge, which can be damaged with wear.

Current flooring edge finishing products are ineffectual and unattractive. One method of preventing flooring edge fraying involves stapling the raw edge of the flooring with large metal staples, which is both unsightly and hazardous, as the staples inevitably detach with wear. Another method involves stitching the end of a carpet with heavy yarn, which stitching is inelegant and unravels with time. Furthermore, stitching requires expensive, heavy-duty sewing machines. Still another method pertains to gluing the edge of the flooring, which application and outcome is messy and displeasing to the eye. Thus, there exists a need for a visually-appealing and durable product and method for finishing the edge of a carpet or hard surface flooring, which the present disclosure provides.

BRIEF SUMMARY

The present application is directed to an attractive and resilient flooring edge finish, which provides the look of a factory or custom finish to the edge of a carpet or a hard surface flooring. Upon installation, the raw edge of the flooring is securely and discreetly hidden by the flooring edge finish.

One embodiment provides a flooring edge finish comprising a flexible strip including a hinge and an adhesive affixed to a top surface of the flexible strip, wherein the hinge comprises a gap or an absence of the adhesive or a lower amount of the adhesive than that of other areas of the flexible strip, and wherein the flooring edge finish is upwardly foldable along the hinge to bind, protect, and conceal an edge of a flooring.

In another embodiment, the flexible strip comprises (a) a first section located at one end of the flexible strip comprising an adhesive, wherein the adhesive lies along a surface of the flexible strip, which is attachable to a bottom surface of a flooring edge; (b) a second section comprising the hinge, which is adjacent to the first section and applicable to and directly below the flooring edge; and (c) a third section located at a second end of the flexible strip comprising an adhesive along a top surface of the flexible strip, adjacent to the second section, which third section is attachable to a vertical surface of the flooring edge.

Yet another embodiment is a method of finishing a flooring edge comprising (a) applying a flexible strip comprising an adhesive and a hinge comprising a gap or absence of adhesive or lower amount of adhesive, as compared to other areas of the flexible strip, along a flooring edge; (b) bending the hinge of the flexible strip upward toward a top surface of the flooring; and (c) applying heat, pressure, or a combination thereof to the adhesive of the flexible strip to facilitate binding with the flooring edge.

The flooring edge finish described herein has several benefits and advantages. One benefit is that the raw edge of a flooring is hidden by an attractive flooring edge finish thereby providing the look of a custom finish or a factory finish. Another benefit is that that the raw edge of a carpet is bound by the flooring edge finish so that the carpet fibers will not fray at the edge with wear. Yet another benefit is that the back and side of the flooring edge can be covered simultaneously. Yet still another benefit is that the flooring edge finish solves the problem of inconsistent and uneven application due to the presence of the hinge or gap, which serves as an effective guide tool in the method of applying the flooring edge finish. Still another benefit is that the hinge of the flooring edge finish facilitates the bending and snug application of the flooring edge finish around the edge of the flooring because there is no adhesive or a lesser amount of adhesive in the hinge area. Another benefit is that the process for adhering the flooring edge finish can be automated to lessen the time and manufacturing costs of the flooring product.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF EXEMPLARY EMBODIMENTS

Figure 1:
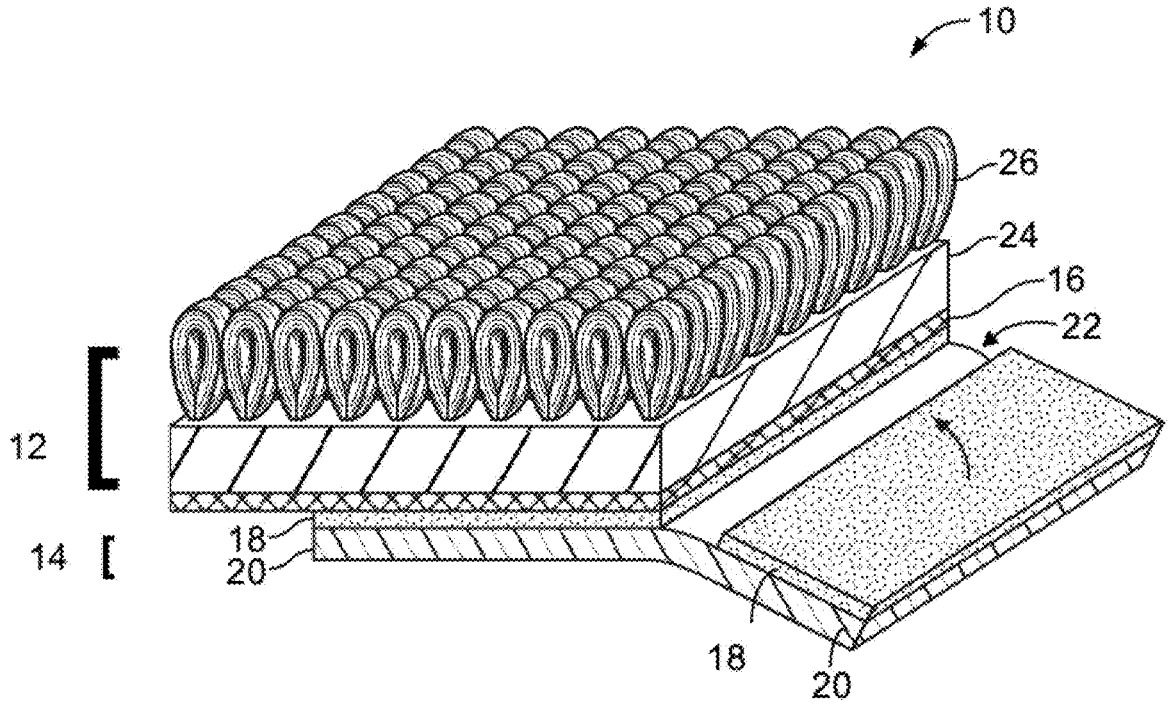
FIG. 1 is a perspective view of a portion of the flooring edge finish with a carpet located on top of the flooring edge finish before adhesion of the flooring edge finish to the carpet's raw edge.

FIG. 1 shows a particular embodiment of an unbound assembly 10 of a carpet 12 and a flooring edge finish 14. The carpet 12 has face fibers 26 embedded into a carpet backing 24 and a carpet pad 16, which is optional, underneath the carpet backing 24. The flooring edge finish 14 includes a flexible strip 20 having an adhesive 18 on a top surface of the flexible strip 20 and a hinge 22 comprising a gap or an absence of the adhesive or a lower amount of the adhesive 18 on a portion of the top surface of the flexible strip 20. The flooring edge finish 14 is upwardly foldable along the hinge 22 to bind, protect, and conceal an edge of a flooring.

Figure 2:
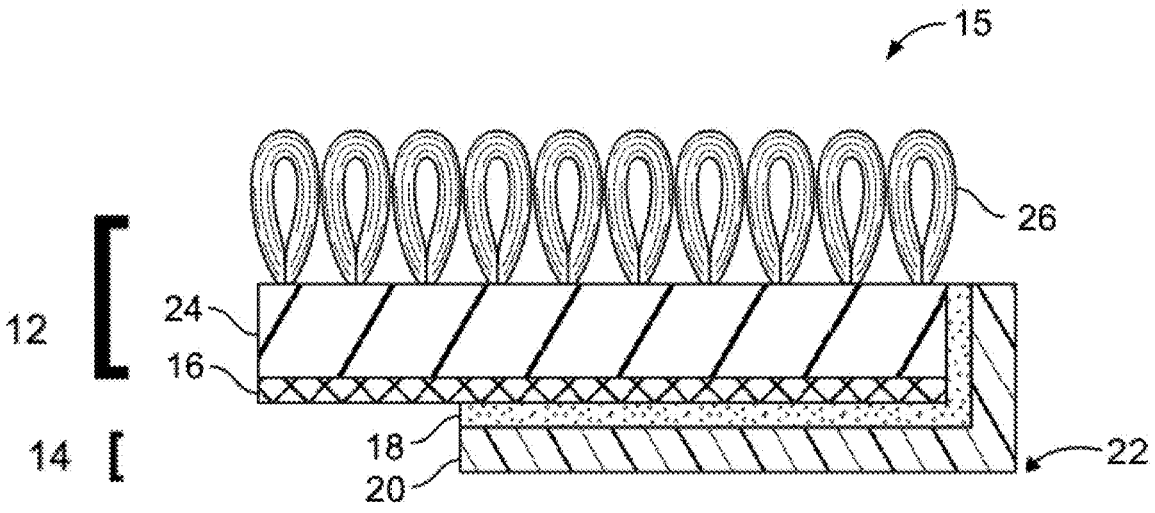
FIG. 2 is a perspective view of a portion of the flooring edge finish with a carpet located on top after adhesion of the flooring edge finish to the carpet's raw edge.

FIG. 2 shows a particular embodiment of a bound assembly 15 of a flooring edge finish 14 adhered to a carpet 12. As in FIG. 1, the carpet 12 has fibers 26 embedded into a carpet backing 24 and an optional carpet pad 16 underneath the carpet backing 24. The flooring edge finish 14 has been folded upward approximately 90 degrees along the hinge 22 so that the adhesive 18 contacts the carpet pad 16 and the carpet backing 24. The flooring edge finish 14 having the flexible strip 20 and the adhesive 18 binds and covers the carpet 12.

In another embodiment, the flexible strip 20 comprises (a) a first section located at one end of the flexible strip 20 comprising an adhesive 18, wherein the adhesive 18 lies along a surface of the flexible strip 20, which adhesive 18 is attachable to a bottom surface of a flooring edge; (b) a second section comprising the hinge 22, which is adjacent to the first section and applicable to and directly below the flooring edge; and (c) a third section located at a second end of the flexible strip 20 comprising an adhesive 18 along a top surface of the flexible strip 20, which third section is attachable to a vertical section of the flooring edge. The flooring edge can be an edge of a carpet, a hard surface flooring, a transition strip between two flooring materials, a luxury vinyl tile, a resilient vinyl flooring, a laminate flooring, or a mixture thereof. Similarly, the flooring can be a carpet, a hard surface flooring, a luxury vinyl tile, a resilient vinyl flooring, a laminate flooring, or a mixture thereof.

In general, the flexible strip 20 can be almost any length, including at least the length or perimeter of the entire carpet 12 or hard surface flooring. In another embodiment, the length of the flexible strip is substantially the same as the length of the perimeter of the flooring, or exceeds the length of the perimeter of the flooring. In another embodiment, the flexible strip 20 comprises a length of about 1 to 12 inches and a width of about 0.1 to 6 inches. In another embodiment, the flexible strip comprises multiple flexible strips in sequence. In another embodiment, the length of the hinge 22, or second section and the length of the third section, each can also be almost any length, including at least the length or perimeter of the entire carpet 12 or hard surface flooring. In another embodiment, the length of the hinge and/or third section is substantially the same as the length of the perimeter of the flooring, or exceeds the length of the perimeter of the flooring. In another embodiment, the length of the hinge comprises a length of about 1 to 12 inches and a width of about 0.1 to about 1 inch. In yet another embodiment, the length of the first and third sections each can be about 1 to 12 inches with a width of about 0.1 to 6 inches.

In another embodiment, the width of the third section of the flexible strip 20 is comparable to the height of a carpet backing 24 of the edge of the carpet 12, the height of the face fiber of the carpet 12, or extends to partially cover a portion of the face fiber 26. In yet another embodiment, the width of the third section of the flexible strip 20 is comparable a height of a flooring backing, a height of top surface of the flooring, or extends to partially cover a portion of the top surface of the flooring when the hinge of the second section of the flexible strip is folded upward toward the top surface of the flooring.

In still another embodiment, the second end of the flexible strip 20 is flush with a top surface of the carpet backing 24 or with a carpet face fiber 26 or extends farther to partially cover a portion of the face fiber 26 when the hinge 22 of the second section of the flexible strip 20 is folded upward toward the top surface of the carpet 12. In another embodiment, the second end of the flexible strip 20 is lower than a top surface of a carpet face fiber 26 when the hinge 22 of the second section of the flexible strip 20 is folded upward toward the top surface of the carpet 12.

In yet another embodiment, the second end of the flexible strip 20 is flush with a top surface of the hard surface flooring or extends farther to partially cover a portion of the hard surface flooring when the hinge 22 of the second section of the flexible strip 20 is folded upward toward the top surface of the hard surface flooring. In another embodiment, the second end of the flexible strip 20 is lower than a top surface of a hard surface flooring when the hinge 22 of the second section of the flexible strip 20 is folded upward toward the top surface of the hard surface flooring.

The hinge 22 can include an about 90-degree bend in the flexible strip 20 along a bottom section of the edge of the flooring after binding of the third section of the flexible strip 20 to an edge of the flooring. The hinge 22 can also comprise a bend of about 20-170 degrees after binding of the third section of the flexible strip 20 to the flooring edge. In addition, the hinge 22 can include a gap or an area comprising less adhesive 18 than that on other areas of the flexible strip 20. The hinge 22 also can comprise multiple hinges or multiple gaps having little or no adhesive.

The flexible strip 20 can be made of a woven or non-woven composition comprising a natural fiber, a synthetic fiber, or a mixture thereof. Exemplary material includes natural fibers; thermoplastics; rubber; polytetrafluoroethylene; or a mixture thereof. Natural fibers include cotton, wool, hemp, silk, cellulose, or a mixture thereof. Thermoplastic fibers include polyester, polypropylene acrylic, nylon, polypropylene, polystyrene, or a mixture thereof. The flexible strip 20 can be a material comprising a paper, a fabric, a plastic, or a mixture thereof. In general, the fabric and/or fibers of the flooring edge finish 14 can be similar to that of the composition of the related flooring. The flexible strip 20 can comprise one piece of material or multiple pieces of material stitched or otherwise attached together.

The flexible strip 20 can further comprise an additive. For example, an antimicrobial compound can be added to the flexible strip 20. In another embodiment, a dye can be added to the flexible strip 20 so that the flooring edge finish 14 matches the carpet 12 or hard surface flooring to which it will be attached. The flexible strip 20 can also include a decorative material comprising a braid or a tassel.

The flexible strip's adhesive 18 comprises one or more layers comprising a hotmelt adhesive, a tape adhesive, or a mixture thereof. The adhesive 18 of the first and third sections can be the same or different. The second section, the hinge 22, either contains no adhesive, or a lesser amount of adhesive 18, or a thinner amount of adhesive 18 than the amount on the first and third sections of the flexible strip 20. The adhesive 18 of any of the sections of the flexible strip 20 can be the same as or different from the adhesive 18 of the other sections. Also, the adhesive 18 can comprise two or more types of adhesives that are stacked on top of each other as layers. The thickness of the adhesive 18 comprises about 0.1 to 1 inch. The adhesive 18 can be pre-applied to the flexible strip 20 or can be applied at a later time, before application of the flexible strip to the flooring edge. The application of heat and/or pressure activates the adhesive 18.

One example of a flooring edge finish 14 comprises a flexible strip 20 that includes (a) a first section located at one end of the flexible strip 20 comprising a width of 1¼ inches, which is attachable to a bottom surface of a flooring edge; (b) a second section comprising a hinge 22 comprising a width of 1/32 inch, which is adjacent to the first section and applicable to and directly below a flooring edge; and (c) a third section located at a second end of the flexible strip 20 comprising a width of 1/8 inch, which is adjacent to the second section and is attachable to a flooring edge; wherein an adhesive 18 is affixed to a top surface of the flexible strip 20; wherein the hinge 22 comprises a gap or absence of the adhesive or a lower amount of adhesive, as compared to other sections along the top surface of the flexible strip 20; and wherein the flooring edge finish 14 is upwardly foldable along the hinge 22 to bind, protect, and conceal the vertical edge of a carpet 12 or a hard flooring surface. The flexibles strip can also act as a transition strip between two flooring materials.

The present application is also directed to a method of finishing a flooring edge comprising (a) applying a flooring edge finish 14 comprising a flexible strip 20 comprising an adhesive 18 and a hinge 22 comprising a gap or absence of adhesive or lower amount of adhesive 18 as compared to other sections along the top surface of the flexible strip 20, along a flooring edge; (b) bending the hinge 22 upward toward a top surface of the flooring; and (c) applying heat, pressure, or a combination thereof to the adhesive 18 to facilitate binding with the flooring edge. The presence of the hinge or gap, which serves as an effective guide tool in the method of applying the flooring edge finish 14. The hinge 22 of the flooring edge finish 14 facilitates the snug bending and folding of the flooring edge finish 14 around the edge of the flooring because there is no adhesive 18 or a lesser amount of adhesive 18 in the hinge area so bending is easier and more exact. One or more sides or edges of the flooring can be covered simultaneously. The process for adhering the flooring edge finish can be automated to lessen the time and manufacturing costs of the flooring product.

The application process can be accomplished by heating the flexible strip 20 containing the adhesive 18 with on by hand or by a machine process. All sides of the corner of a carpet 12 or hard surface flooring can be finished at once or done one side at a time. The attachment of the flexible strip 20 to the back of the flooring can be done at the same time or at a different time as the binding of the flooring edge finish 14. In one embodiment, a hand-held tool is used to heat the flexible strip 20 as the flexible strip 20 is pressed against the flooring to provide adherence. In another embodiment, the flexible strip 20 having a peel and seal adhesive 18 can be used to position the flexible strip 20, holding it in place until the final adherence with another stronger adhesive 18, such as a hot-melt adhesive. In a continuous process, the flooring edge finish 14 can be fed parallel to the flooring, which would properly position the flexible strip 20 alongside the flooring edge. Once positioned, the flooring edge finish 14 could be heated as it travels with the flooring through the machinery of the continuous process.

Figure 3:
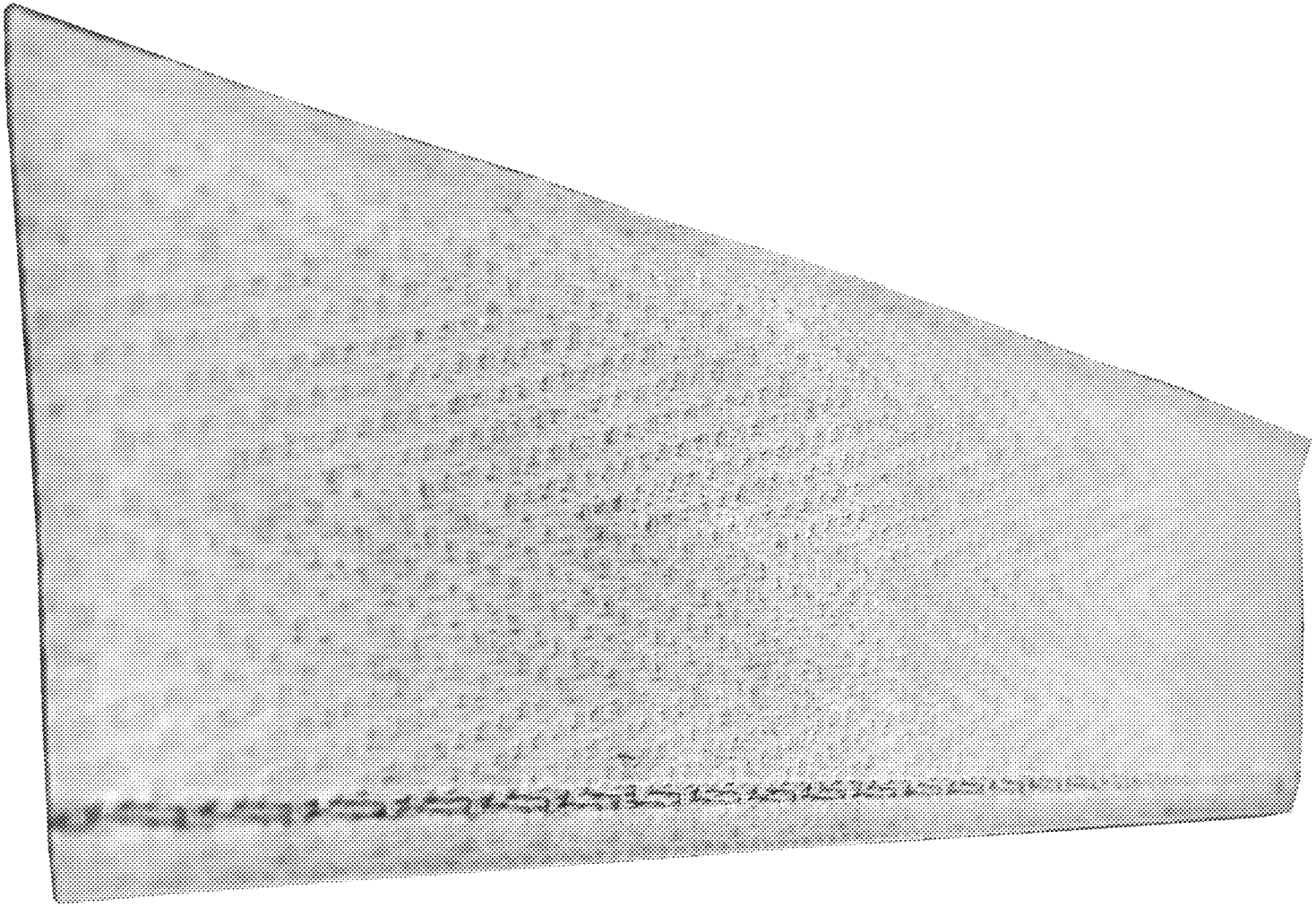
FIG. 3 is a photo of the flooring edge finish comprised of a flexible strip having an adhesive and a hinge section without adhesive.

FIG. 3 is a photo of the flooring edge finish comprised of the flexible strip having an adhesive and a hinge section without adhesive. The adhesive is a hot melt adhesive. The flexible strip is made of woven cotton binding tape. The three sections of the flexible strip are visible with the first section of flexible strip having adhesive on the surface, at the left of the photo. The first section is about an inch wide. The second section of flexible strip comprising the hinge is in the middle of the photo. The flexible strip does not have adhesive at the hinge section and is about 1/16 of an inch wide. To the far right, in the photo, is the third section on the flexible strip, which has adhesive. The third section is about 3/16 of an inch wide.

Figure 4:
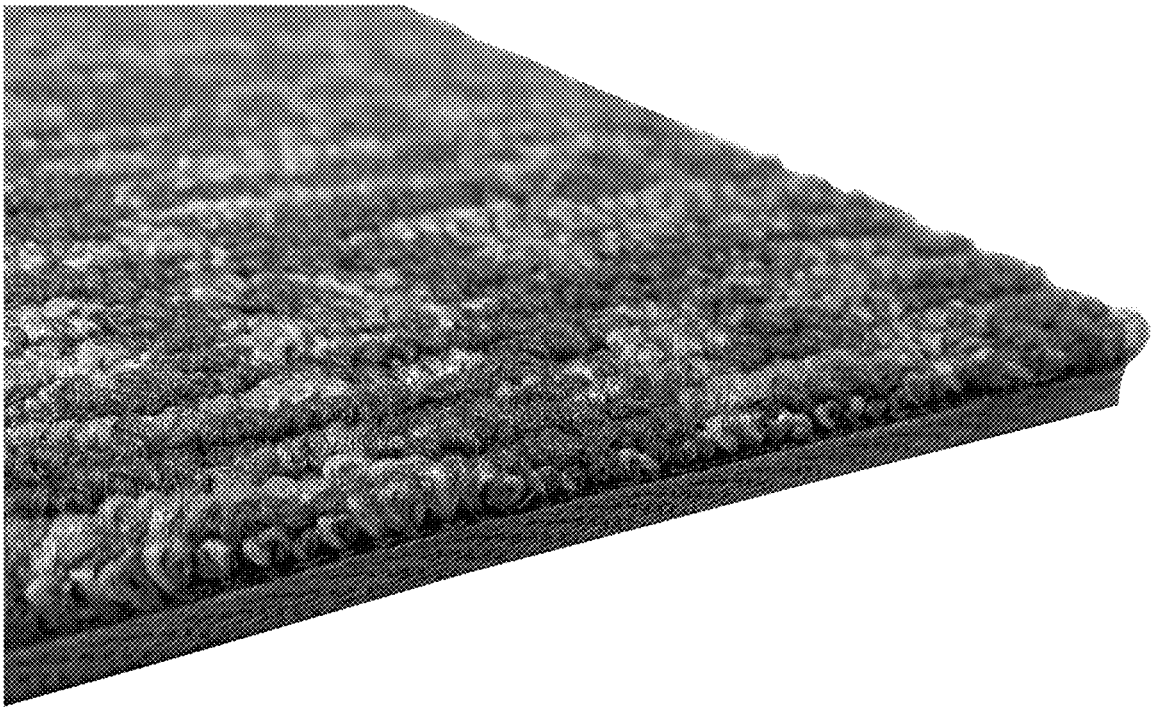
FIG. 4 is a photo of the flooring edge finish bound to a raw edge of a carpet.

FIG. 4 is a photo of the flooring edge finish of FIG. 3, as applied and bound to a raw edge of a carpet.

Figure 5:
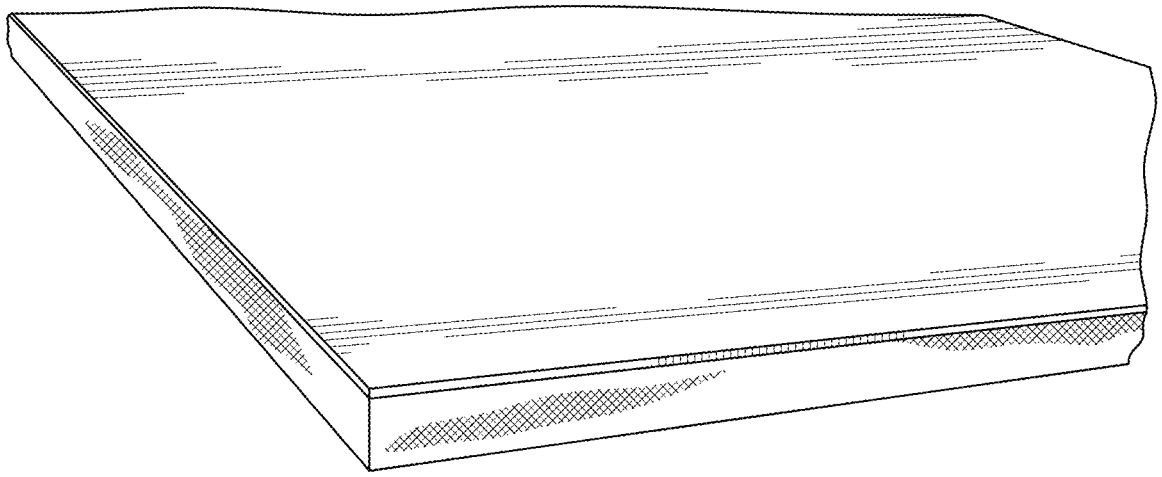
FIG. 5 is a photo of the flooring edge finish bound to a raw edge of a hard surface flooring.

FIG. 5 is a photo of the flooring edge finish of FIG. 3, as applied and bound to a raw edge of a hard surface flooring.

Figure 6:
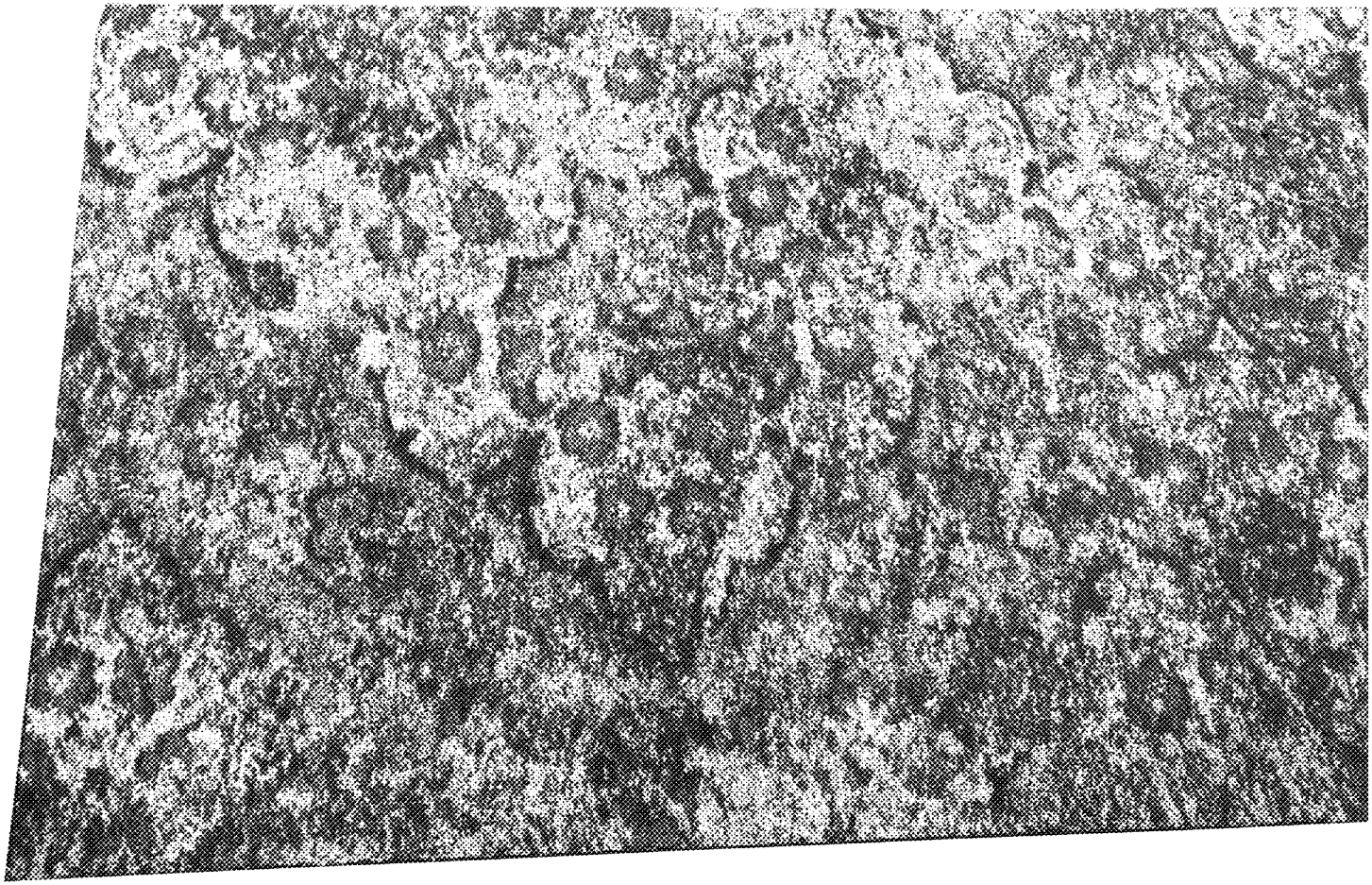
FIG. 6 is a photo of the flooring edge finish used as a transition strip in a mixed materials flooring installation, specifically luxury vinyl tile and carpet.

FIG. 6 is a photo of the flooring edge finish of FIG. 3, as applied and bound to a raw edge of a carpet and used as a transition strip in a mixed materials flooring installation, specifically luxury vinyl tile and carpet.

Figure 7:
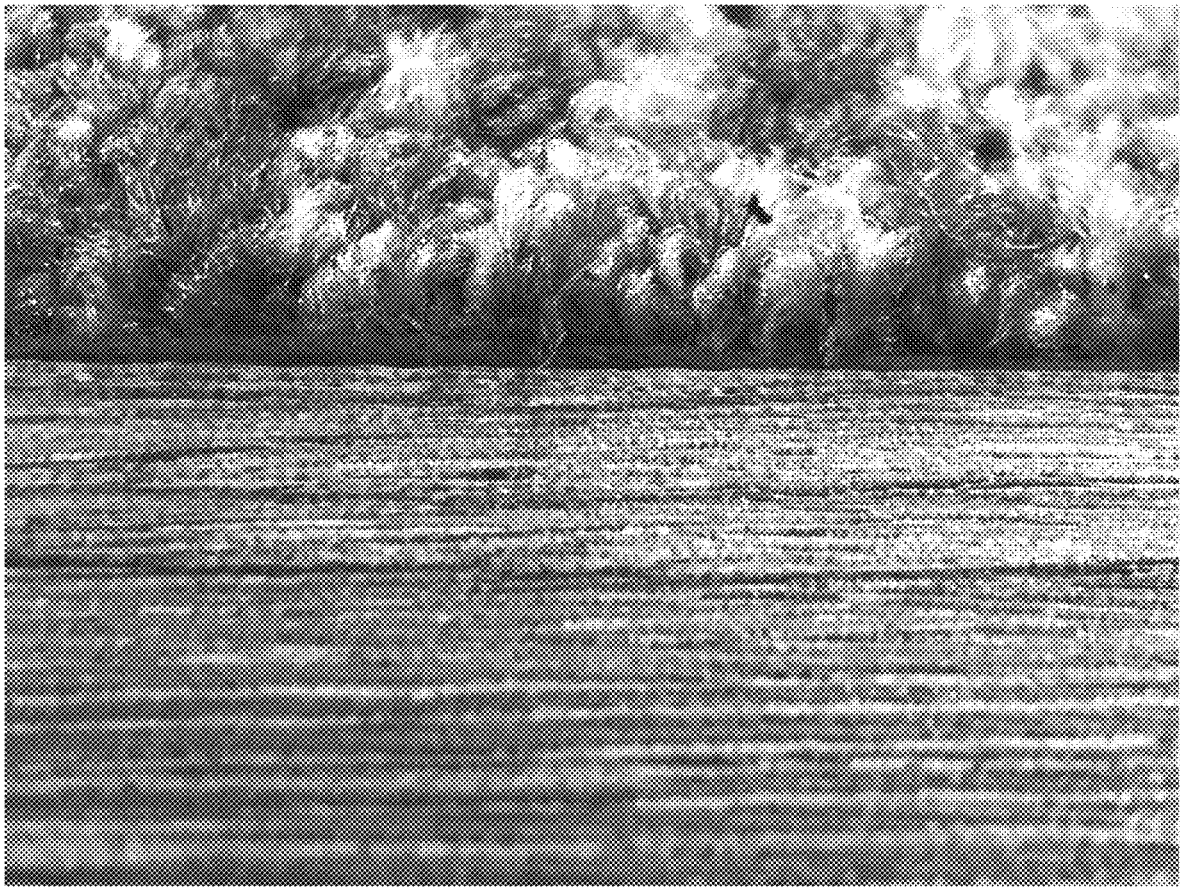
FIG. 7 is a close-up photo of the flooring edge finish used as a transition strip in a mixed materials flooring installation, specifically luxury vinyl tile and carpet.

FIG. 7 is a close-up photo of the flooring edge finish of FIG. 6, which is used as a transition strip in a mixed materials flooring installation, specifically luxury vinyl tile and carpet.

Alternative embodiments of the subject matter of this application will become apparent to one of ordinary skill in the art to which the present invention pertains, without departing from its spirit and scope. It is to be understood that no limitation with respect to specific embodiments shown here is intended or inferred.

We claim:

1. A flooring edge finish comprising a flexible strip comprising a hinge and an adhesive affixed to a top surface of the flexible strip, wherein the hinge comprises a gap or an absence of the adhesive or a lower amount of the adhesive than that of other areas of the flexible strip, wherein the flooring edge finish is upwardly foldable along the hinge to bind to a vertical surface of an edge of a flooring without concealing a top horizontal surface of the flooring, and wherein an end of the flexible strip is permanently adhered to a vertical surface of the edge of the flooring and is permanently adhered to a portion of a bottom horizontal surface of the edge of the flooring that is in direct contact with the vertical surface of the edge of the flooring.

2. The flooring edge finish of claim 1 wherein the flexible strip comprises:

(a) a first section located at one end of the flexible strip comprising an adhesive, wherein the adhesive lies along a surface of the flexible strip, which adhesive is attachable to a bottom surface of a flooring edge;

(b) a second section comprising the hinge, which is adjacent to the first section and applicable to and directly below the flooring edge; and (c) a third section located at a second end of the flexible strip comprising an adhesive along a surface of the flexible strip, adjacent to the second section, which third section is attachable to a vertical surface of the flooring edge.

3. The flooring edge finish of claim 2 wherein the hinge comprises an about 90 degree bend in the flexible strip along a bottom section of the flooring edge after binding of the third section of the flexible strip to the flooring edge.

4. The flooring edge finish of claim 2 wherein the adhesive of any of the sections of the flexible strip are the same or different than the adhesive of other sections.

5. The flooring edge finish of claim 1 wherein the flexible strip comprises one or more flexible strips.

6. The flooring edge finish of claim 1 wherein the flexible strip further comprises an additional peel and seal adhesive to aid in positioning the flexible strip in proper position before permanently adhering to the flooring.

7. The flooring edge finish of claim 1 wherein the flexible strip comprises a decorative material comprising a braid or a tassel.

8. The flooring edge finish of claim 1 wherein the flexible strip comprises a woven or non-woven composition comprising a natural fiber, a synthetic fiber, or a mixture thereof.

9. The flooring edge finish of claim 1 wherein the flexible strip comprises natural fibers; thermoplastics; rubber; polytetrafluoroethylene; or a mixture thereof.

10. The flooring edge finish of claim 1 wherein the flexible strip comprises a material comprising a paper, a fabric, a plastic, or a mixture thereof.

11. The flooring edge finish of claim 1 wherein a length of the hinge, or second section, and a length of the third section each comprise a length comparable to the length of the flexible strip.

12. The flooring edge finish of claim 1 wherein the hinge comprises multiple hinges or multiple gaps.

13. The flooring edge finish of claim 1 wherein the hinge comprises an about 20-170 degree bend in the flexible strip along a bottom section of the flooring edge after binding of the third section of the flexible strip to the flooring edge.

14. The flooring edge finish of claim 1 wherein the flexible strip comprises an additive comprising an antimicrobial compound.

15. The flooring edge finish of claim 1 wherein the adhesive comprises one or more layers comprising a hotmelt adhesive, a tape adhesive, or a mixture thereof.

16. The flooring edge finish of claim 1 wherein a thickness of the adhesive comprises about 0.1 to 1 inch.

17. The flooring edge finish of claim 1 wherein the flexible strip comprises one piece of material or multiple pieces of material attached together.

18. The flooring edge finish of claim 1 wherein the adhesive is pre-applied to the flexible strip.

19. A flooring edge finish comprising a flexible strip comprising:

(a) a first section located at one end of the flexible strip comprising a width of 1¼ inches, which is attachable to a bottom surface of a flooring edge;

(b) a second section comprising a hinge comprising a width of 1/32 inch, which is adjacent to the first section and applicable to and directly below the flooring edge; and (c) a third section located at a second end of the flexible strip comprising a width of ⅛ inch, which is adjacent to the second section and is attachable to a vertical surface of the flooring edge;

wherein an adhesive is affixed to a top surface of the flexible strip;

wherein the hinge comprises a gap or absence or a lower amount of adhesive as compared to other sections, along the top surface of the flexible strip, and wherein the flexible strip is upwardly foldable along the hinge to permanently bind, protect, and conceal a vertical edge of the flooring without concealing a top horizontal surface of the flooring and to permanently adhere to a portion of a bottom horizontal surface that is adjacent to and in contact with the vertical edge of the flooring.

20. A method of finishing a flooring edge comprising:

(a) applying a flooring edge finish comprising a flexible strip comprising an adhesive and a hinge comprising a gap or absence of adhesive or lower amount of adhesive, as compared to other areas of the flexible strip, along a flooring edge;

(b) bending the hinge upward toward a top surface of the flooring;

(c) applying heat, pressure, or a combination thereof to the adhesive to facilitate permanent binding of an end of the flexible strip with a vertical surface of the flooring edge and a portion of a bottom horizonal surface of the flooring adjacent to the vertical surface of the flooring edge without concealing a top horizontal surface of the flooring.

* * * * *